US007377327B2

(12) United States Patent
Jackson

(10) Patent No.: US 7,377,327 B2
(45) Date of Patent: May 27, 2008

(54) VARIABLE CHOKE VALVE

(75) Inventor: Stephen L. Jackson, Richmond, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 342 days.

(21) Appl. No.: 11/181,248

(22) Filed: Jul. 14, 2005

(65) Prior Publication Data

US 2007/0012458 A1 Jan. 18, 2007

(51) Int. Cl.
*E21B 33/12* (2006.01)
*E21B 34/00* (2006.01)

(52) U.S. Cl. ..... 166/386; 166/325; 166/334.1

(58) Field of Classification Search ..... None
See application file for complete search history.

(56) References Cited

U.S. PATENT DOCUMENTS

| | | | |
|---|---|---|---|
| 2,317,021 | A | 4/1943 | Bassinger |
| 2,888,080 | A | 5/1959 | Tausch et al. |
| 3,051,243 | A | 8/1962 | Grimmer et al. |
| 3,071,193 | A | 1/1963 | Raulins |
| 3,151,681 | A | 10/1964 | Cochran |
| 3,395,758 | A | 8/1968 | Kelly et al. |
| 3,414,060 | A | 12/1968 | Zak |
| 4,532,987 | A | 8/1985 | Reed |
| 4,971,099 | A | 11/1990 | Cyvas |
| 5,156,220 | A | 10/1992 | Forehand et al. |
| 5,263,683 | A | 11/1993 | Wong |
| 5,299,640 | A | 4/1994 | Streich et al. |
| 5,309,993 | A | 5/1994 | Coon et al. |
| 5,316,084 | A | 5/1994 | Murray et al. |
| 5,443,129 | A | 8/1995 | Bailey et al. |
| 5,611,547 | A | 3/1997 | Baugh et al. |
| 5,718,289 | A | 2/1998 | Schnatzmeyer et al. |
| 5,896,928 | A | 4/1999 | Coon |
| 5,906,238 | A | 5/1999 | Carmody et al. |
| 5,957,207 | A | 9/1999 | Schnatzmeyer |
| 5,957,208 | A | 9/1999 | Schnatzmeyer |

(Continued)

FOREIGN PATENT DOCUMENTS

| | | |
|---|---|---|
| EP | 0 893 575 | 1/1999 |

(Continued)

OTHER PUBLICATIONS

U.K. Search Report, Application No. GB0613871.3, dated Mar. 8, 2007.

(Continued)

*Primary Examiner*—Frank Tsay
(74) *Attorney, Agent, or Firm*—Patterson & Sheridan, L.L.P.

(57) ABSTRACT

Embodiments of the present invention generally provide a more reliable variable choke flow control valve. In one embodiment, a variable choke valve for use in a wellbore is provided. The valve includes a tubular housing having an axial bore therethrough and a port through a wall thereof. The valve further includes a tubular sleeve having an axial bore therethrough and first and second holes through a wall thereof and disposed within the housing. The first hole is larger than the second hole, and the sleeve is actuatable among three positions: a first position where the first hole is aligned with the port, a second position where the second hole is aligned with the port, and a third position where the sleeve wall is aligned with the port.

30 Claims, 10 Drawing Sheets

U.S. PATENT DOCUMENTS

| | | | |
|---|---|---|---|
| 5,979,558 | A | 11/1999 | Bouldin et al. |
| 6,041,857 | A | 3/2000 | Carmody et al. |
| 6,044,908 | A | 4/2000 | Wyatt |
| 6,070,670 | A | 6/2000 | Carter et al. |
| 6,082,458 | A | 7/2000 | Schnatzmeyer |
| 6,112,816 | A | 9/2000 | Orzechowski et al. |
| 6,253,850 | B1 | 7/2001 | Nazzai et al. |
| 6,260,616 | B1 | 7/2001 | Carmody et al. |
| 6,276,458 | B1 | 8/2001 | Malone et al. |
| 6,293,344 | B1 | 9/2001 | Nixon et al. |
| 6,308,783 | B2 | 10/2001 | Pringle et al. |
| 6,318,729 | B1 | 11/2001 | Pitts, Jr. et al. |
| 6,328,112 | B1 | 12/2001 | Malone |
| 6,328,729 | B1 | 12/2001 | Jervis |
| 6,334,486 | B1 | 1/2002 | Carmody et al. |
| 6,343,651 | B1 | 2/2002 | Bixenman |
| 6,446,729 | B1 | 2/2002 | Bixenman et al. |
| 6,422,317 | B1 | 7/2002 | Williamson, Jr. |
| 6,450,225 | B2 | 9/2002 | Yukawa et al. |
| 6,484,800 | B2 | 11/2002 | Carmody et al. |
| 6,494,265 | B2 | 12/2002 | Wilson et al. |
| 6,513,599 | B1 | 2/2003 | Bixenman et al. |
| 6,516,888 | B1 | 2/2003 | Gunnarson et al. |
| 6,575,243 | B2 | 6/2003 | Pabst |
| 6,612,547 | B2 | 9/2003 | Carmody et al. |
| 6,668,935 | B1 | 12/2003 | McLoughlin et al. |
| 6,715,558 | B2 | 4/2004 | Williamson |
| 6,722,439 | B2 | 4/2004 | Garay et al. |
| 6,860,330 | B2 | 3/2005 | Jackson |
| 6,869,063 | B2 | 3/2005 | Gunnarson et al. |
| 6,880,638 | B2 | 4/2005 | Haughom et al. |
| 6,966,380 | B2 | 11/2005 | McLoughlin et al. |
| 6,973,974 | B2 | 12/2005 | McLoughlin et al. |
| 2003/0056951 | A1 | 3/2003 | Kaszuba |
| 2003/0159832 | A1 | 8/2003 | Williamson |
| 2004/0041120 | A1 | 3/2004 | Haughom et al. |
| 2004/0129431 | A1 | 7/2004 | Jackson |
| 2005/0139362 | A1 | 6/2005 | Coon et al. |
| 2005/0263279 | A1 | 12/2005 | Vachon |

FOREIGN PATENT DOCUMENTS

| | | |
|---|---|---|
| WO | WO 00/75484 | 12/2000 |
| WO | WO 00/79094 | 12/2000 |
| WO | WO 01/21935 | 3/2001 |
| WO | WO 02/16730 | 2/2002 |

OTHER PUBLICATIONS

U.K. Search Report, Application No. GB0613871.3, dated Nov. 9, 2006.

VARIABLE CHOKE VALVE

CROSS REFERENCE TO RELATED APPLICATIONS

U.S. patent application Ser. No. 10/748,695, entitled "Seal Stack for Sliding Sleeve"), filed Dec. 30, 2003 is herein incorporated by reference.

BACKGROUND OF THE INVENTION

1. Field of the Invention

Embodiments of the present invention generally relate to valves for use in wellbores.

2. Description of the Related Art

Subsequent to the drilling of an oil or gas well, the well is completed by running into such well a string of casing which is cemented in place. Thereafter, the casing is perforated to permit the fluid hydrocarbons to flow into the interior of the casing and subsequently to the top of the well. Such produced hydrocarbons are transmitted from the production zone of the well through a production tubing or work string which is concentrically disposed relative to the casing.

In many well completion operations, it frequently occurs that it is desirable, either during the completion, production, or workover stages of the life of the well, to have fluid communication between the annular area between the interior of the casing and the exterior of the production tubing or workstring with the interior of such production tubing or workstring for purposes of, for example, injecting chemical inhibitor, stimulants, or the like, which are introduced from the top of the well through the production tubing or workstring and to such annular area. Alternatively, it may be desirable to provide such a fluid flow passageway between the tubing/casing annulus and the interior of the production tubing so that actual production fluids may flow from the annular area to the interior of the production tubing, thence to the top of the well. Likewise, it may be desirable to circulate weighting materials or fluids, or the like, down from the top of the well in the tubing/casing annulus, thence into the interior of the production tubing for circulation to the top of the well in a "reverse circulation" pattern.

In instances as above described, it is well known in the industry to provide a well tool having a port or ports therethrough which are selectively opened and closed by means of a sliding sleeve element positioned interiorly of the well tool. Such sleeve typically may be manipulated between open and closed positions by means of wireline, remedial coiled tubing, electric line, or any other well known auxiliary conduit and tool means. In some tools, it is desirable to provide intermediate positions between the open and closed positions so that flow through the tool may be regulated. One way to accomplish this is to mismatch the slots in the sleeve with the port(s) in the housing. Another way is to configure the sleeve with a plurality of different sized slots and to configure the tool so that the different slots may be selectively aligned with the port in the housing.

Typically, in tools having the multi-sized slots, the tool must contain some sort of elastomeric or metallic sealing element used to isolate the port and currently aligned slot from the rest of the slots and the tool. This same sealing element is also used to isolate the slots form the port when the tool is in a closed position. Thus, if the sealing element should fail, the tool cannot be effectively closed. Further, such failure could adversely affect the sealing integrity of the entire production tubing conduit.

Typically, in tools configured to regulate flow by mismatching the slots in the sleeve with the port(s) in the housing, a series of upper and lower primary seals are placed in the housing for dynamic sealing engagement relative to the exterior of the sleeve which passes across the seals during opening and closing of the port element. As with all seals, such primary sealing means also represent an area of possible loss of sealing integrity.

Accordingly, there is a need for a variable choke flow control tool with a seal configuration which is more reliable, thereby reducing the chances of loss of sealing integrity through the tool and the tubular conduit.

SUMMARY OF THE INVENTION

Embodiments of the present invention generally provide a more reliable variable choke flow control valve. In one embodiment, a variable choke valve for use in a wellbore is provided. The valve includes a tubular housing having an axial bore therethrough and a port through a wall thereof. The valve further includes a tubular sleeve having an axial bore therethrough and first and second holes through a wall thereof and disposed within the housing. The first hole is larger than the second hole, and the sleeve is actuatable among at least three positions: a first position where the first hole is at least partially aligned with the port, a second position where the second hole is at least partially aligned with the port, and a third position where the sleeve wall is at least partially aligned with the port.

In one aspect of the embodiment, the valve further includes a sealing member disposed between the housing and the sleeve and distally from the port, wherein the holes move past the sealing member when the sleeve is actuated to the third position, thereby isolating the holes from the port. Optionally, the sealing member is a seal stack.

In another aspect of the embodiment, the valve further includes an annular sealing member disposed around the housing and distally from the port so that the sealing member isolates the holes from the port when the sleeve is in the third position. Optionally, the sealing member is a seal stack.

In another aspect of the embodiment, the valve further includes a sealing member disposed around the port which isolates the one of the holes from the other of the holes when the one of the holes is aligned with the port. Optionally, the valve includes a spring disposed between the sealing member and the housing, the spring biasing the sealing member into engagement with the sleeve.

In another aspect of the embodiment, the second hole is axially and circumferentially spaced from the first hole, the sleeve is axially actuatable, and the sleeve and housing are coupled so that the sleeve will rotate as the sleeve is being axially actuated. Optionally, one of the sleeve and the housing has a first pin disposed thereon and the other one of the sleeve and the housing has a profiled surface configured to guide the first pin so that the sleeve will rotate as the sleeve is being axially actuated. Optionally, the one of the sleeve and the housing that has the first pin disposed thereon further has a second pin disposed thereon and the profiled surface is further configured to guide the second pin so that actuation of the sleeve will cease when the sleeve has reached any of the three positions. Optionally, the sleeve has a third hole disposed through a wall thereof which is smaller than the first and second holes and axially aligned with the first hole, and the sleeve is actuatable among at least four positions, the third hole being at least partially aligned with the port when the sleeve is in the fourth position. Optionally, the valve is configured so that the sleeve is axially actuated from the first position to the second position in a first axial direction and the sleeve is axially actuated from the second position to the fourth position in a second axial direction, which is opposite to the first axial direction.

In another aspect of the embodiment, the sleeve is axially actuatable by a pressurized fluid, the sleeve actuatable in two axial directions by two fluid lines connectable to the valve and the valve further comprises a bleed which provides limited fluid communication between the two fluid lines.

In another embodiment, a variable choke valve for use in a wellbore is provided. The valve includes a tubular housing having an axial bore therethrough and a port through a wall thereof. The valve further includes a tubular sleeve having an axial bore therethrough and first and second holes through a wall thereof and disposed within the housing, wherein the first hole is larger than the second hole. The valve further includes means for actuating the sleeve among at least three positions: a first position where the first hole is aligned with the port, a second position where the second hole is aligned with the port, and a third position where the sleeve wall is aligned with the port.

In one aspect of the embodiment, the valve further includes means located distally from the port and for isolating the holes from the ports when the sleeve is in the third position.

In another embodiment, a method of using a variable choke valve in a wellbore is provided. The method includes pressurizing a first control line to the valve, wherein the valve will be actuated from an open position to a first choked position. The method further includes pressurizing a second control line to the valve, wherein the valve will be actuated from the first choked position to a second choked position. The method further includes pressurizing one of the two control lines, wherein the valve will be actuated from a choked position to a closed position.

In one aspect of the embodiment, the method further includes pressurizing the other of the two control lines, wherein the valve will be actuated from the closed position to the open position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Descriptors of various parts of a variable choke valve 100, described below, implying a specific orientation, i.e. upper and lower, are meant for use relative to a vertical wellbore and are not meant to limit usage of the valve in any way. The valve may also be used in deviated, i.e. horizontal, wellbores where the descriptors would lose meaning. The valve may also be used upside down. Except for sealing members and unless otherwise specified, the choke valve 100 is made from a metal, such as steel.

Figure 1:
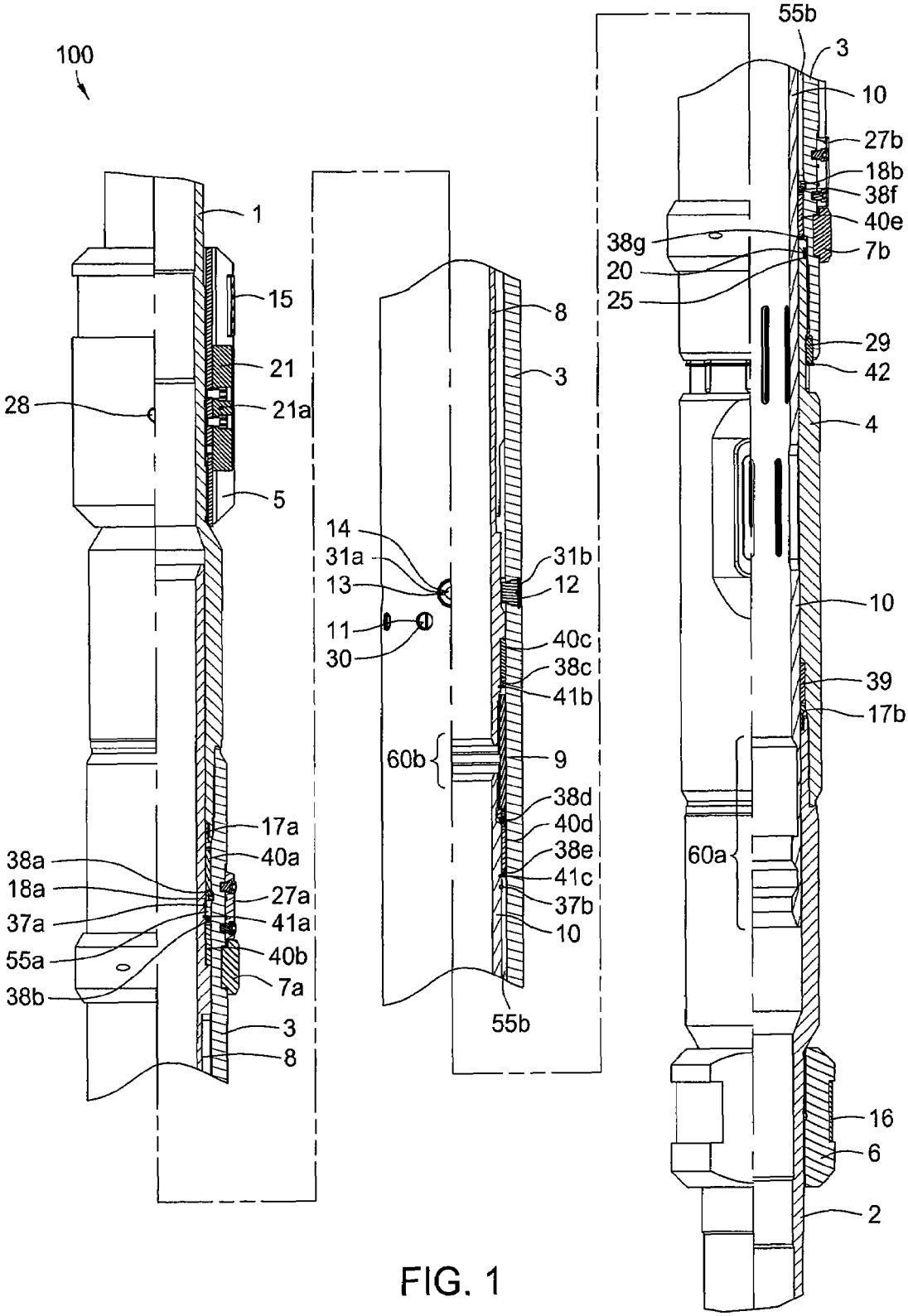
FIG. 1 is a half-sectional/half-side view of the assembled variable choke valve.

FIG. 1 is a half-sectional/half-side view of the assembled variable choke valve 100. The variable choke valve 100 includes a top sub 1. The top sub 1 is a tubular member having a flow bore therethrough. At an upper end, the top sub 1 may include threads for coupling the variable choke valve 100 to a string of tubulars for insertion into a wellbore (not shown). Coupled to the top sub 1 along a middle portion of the top sub 1 by a threaded connection is an upper termination sub 5. Just below the upper termination sub 5, inside and outside diameters of the top sub taper outwardly (facing down the valve 100). This tapered portion of the top sub 1 mates with a lower portion of the upper termination sub 5 when the upper termination sub is coupled to the top sub. Coupled to the upper termination sub 5 by cap screws is an upper control line clamp 15. Also coupled to the upper termination sub 5 by cap screws is an emergency release block 21. Four grippers 28 (one shown) are also coupled to the upper termination sub 5, each by a set screw. The grippers provide a textured surface so that a torque tool (not shown) can be coupled to the upper termination sub 5 for assembly of the upper termination sub onto the top sub 1.

An upper end of a piston housing 3 is coupled to a lower end of the top sub 1 by a threaded connection. The piston housing 3 is a tubular member having a flow bore therethrough. A bottom tip of the top sub 1, just below the threads, is inclined on an outer surface that deforms against an inclined inner surface of the piston housing 3 when the two members are connected, thereby forming a metal-to-metal seal. This metal-to-metal seal isolates the interior of the valve 100 from leakage through the threads.

Figure 2:
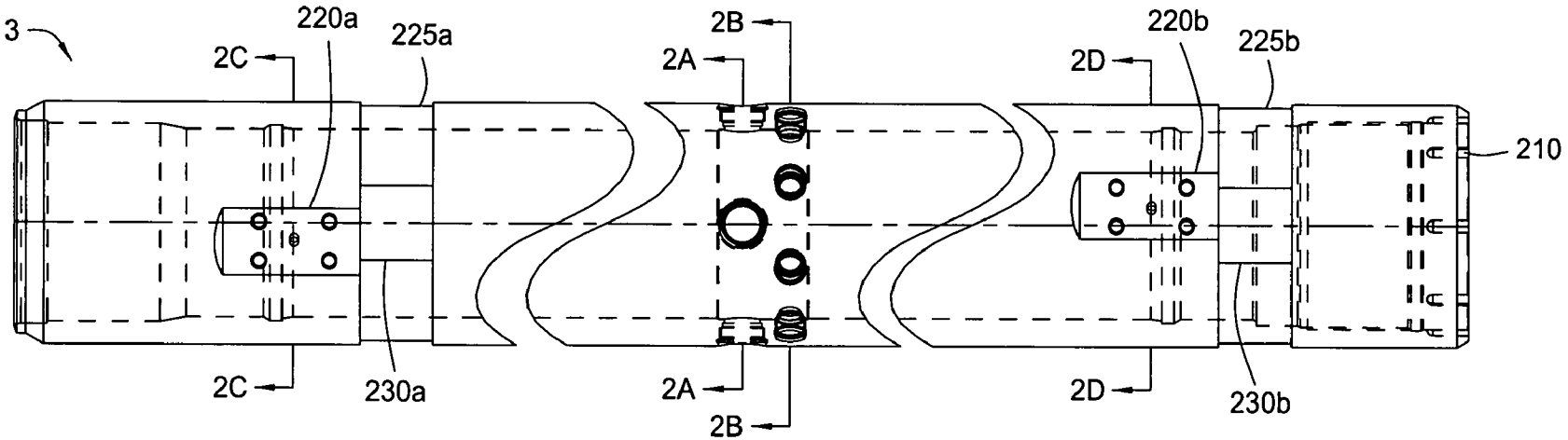
FIG. 2 is a side view of the piston housing of the valve of FIG. 1 with hidden lines showing sectional features.
Figure 2D:
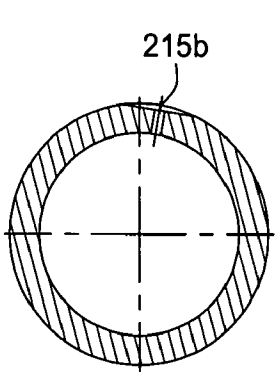
FIGS. 2A, 2B, 2C, and 2D are sectional views taken along the lines 2A-2A, 2B-2B, 2C-2C, and 2D-2D of FIG. 2, respectively.
Figure 2C:
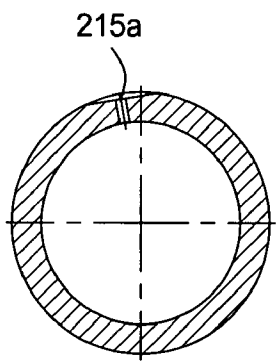
Figure 2B:
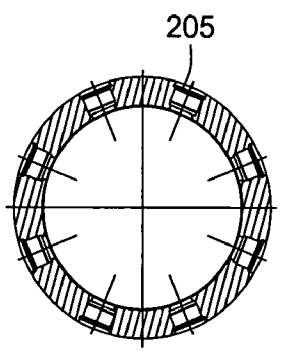
Figure 2A:
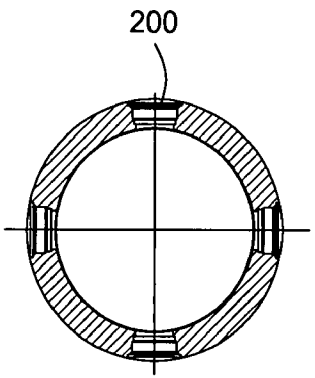

An upper end of a ported housing 4 is coupled to a lower end of the piston housing 3 by a threaded connection. The ported housing 4 is a tubular member having a flow bore therethrough. Unlike the top sub 1/piston housing 3 connection, a top tip of the ported housing 4, just above the threads, is not inclined and is received by a recess in the lower end of the piston housing 3. The top tip of the ported housing is also grooved. Disposed in this groove is an O-ring 20 enclosed by a back-up ring 25. The O-ring 20 isolates the interior of the valve 100 from leakage through the threads. Referring to FIG. 2, a plurality of slots 210 is disposed in the lower end of the piston housing 3. Returning to FIG. 1, disposed in the slots 210 are respective dowel pins 29. The dowel pins 29 are coupled to the piston housing by a retaining ring 42. As compared to the top sub 1/piston housing 3 connection, the piston housing 3/ported housing 4 connection is lightly torqued. The dowel pins are installed as an anti-rotation device to prevent the piston housing 3/ported housing 4 connection from unwinding during service of the valve 100.

An upper end of a bottom sub 2 is coupled to a lower end of the ported housing 4 by a threaded connection. The bottom sub 2 is a tubular member having a flow bore therethrough. Like the top sub 1/piston housing 3 connection, a top tip of the bottom sub 2, just above the threads, is inclined on an outer surface that deforms against an inclined inner surface of the ported housing 4 when the two members are connected, thereby forming a metal-to-metal seal. Coupled to the bottom sub 2 along a middle portion of the bottom sub 2 by a threaded connection is a lower termination sub 6. Just below the lower termination sub 6, inside and outside diameters of the bottom sub 2 taper inwardly (facing down the valve 100). This tapered portion of the bottom sub 2 mates with an upper portion of the lower termination sub 6 when the lower termination sub is coupled to the bottom sub. The lower termination sub 6 is a tubular member having a bore therethrough. Coupled to the lower termination sub 6 by cap screws is a lower control conduit clamp 16.

A piston 8 (see also FIG. 4) is disposed within the flow bores of the top sub 1 and the piston housing 3. The piston 8 is a tubular member having a flow bore therethrough. The tapered portions of the top sub 1 and the bottom sub 2 provide a backstop for axial movement of the piston 8. Coupled to a lower end of the piston 8 is an upper end of a piston coupling 9. The piston coupling 9 is a tubular member having a bore therethrough.

Figure 4:
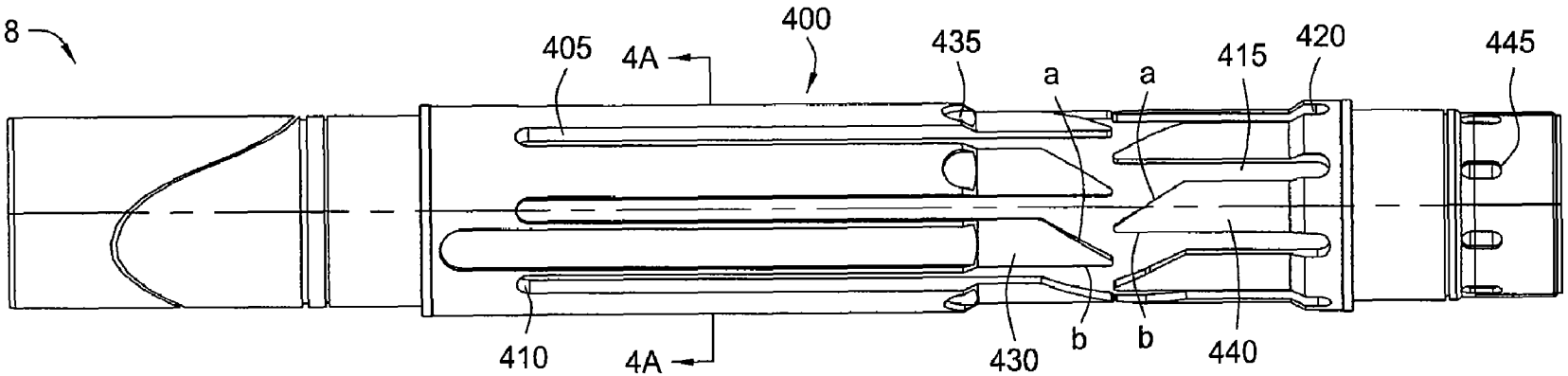
FIG. 4 is a side view of the piston 8 of the valve 100 of FIG. 1.
Figure 5:
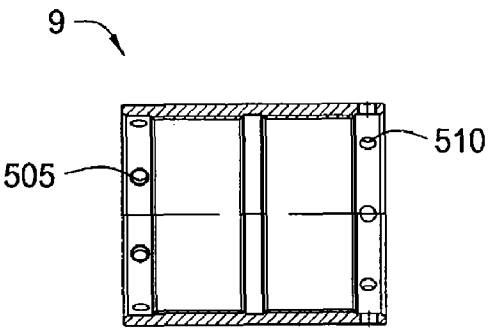
FIG. 5 is a sectional view of the piston coupling of the valve of FIG. 1.

FIG. 5 is a sectional view of the piston coupling 9 of the valve 100 of FIG. 1. The lower end of the piston 8 has a plurality of circumferentially spaced radial holes 445 (see FIG. 4) therethrough which correspond with a plurality of circumferentially spaced radial holes 505 in the upper end of the piston coupling 9, both pluralities for receiving a plurality of set screws, thereby coupling the two members together. Coupled to a lower end of the piston coupling 9 is an upper end of a ported sleeve 10. The ported sleeve 10 is a tubular member having a flow bore therethrough. The lower end of the piston coupling 9 has a plurality of radial holes 510 therethrough which correspond with a plurality of holes 615 (see FIG. 6) in the upper end of the ported sleeve 10, both pluralities for receiving a plurality of set screws, thereby coupling the two members together.

Figure 7A:
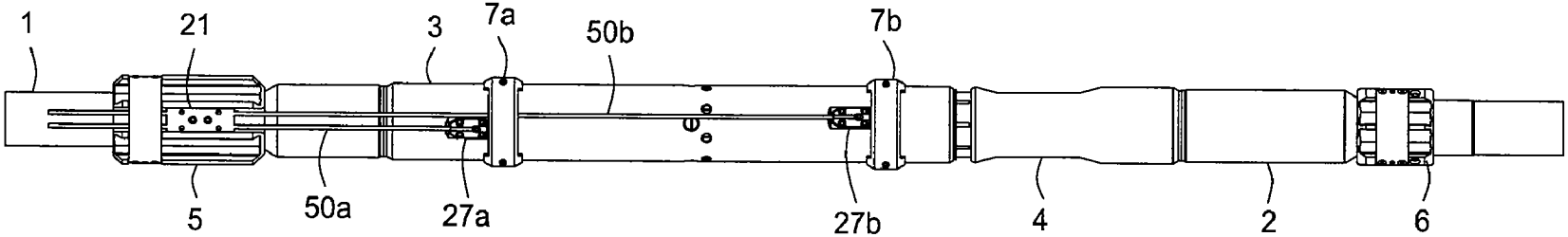
FIGS. 7A and 7B are side views of the valve of FIG. 1.
Figure 7B:
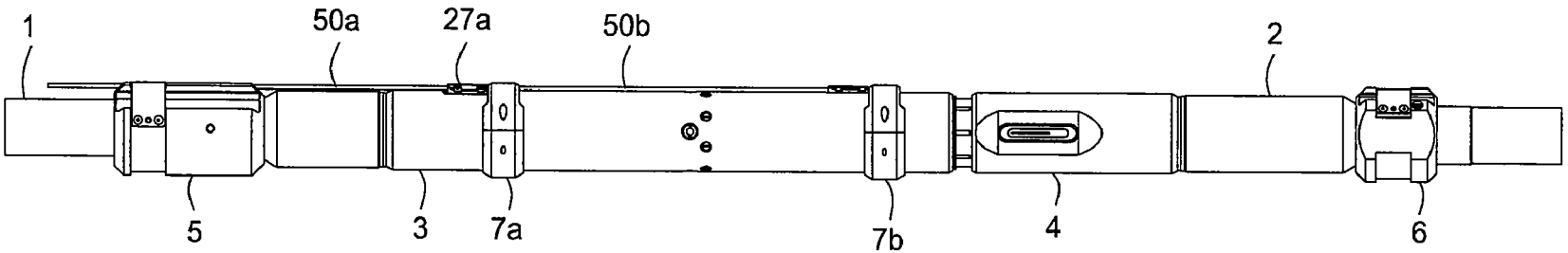

FIGS. 7A and 7B are side views of the valve 100. Referring also to FIG. 1, an upper control line 50*a* is in fluid communication with an upper chamber 55*a* of the piston 8. The upper chamber 55*a* is defined as follows: the piston housing 3 defines an outer surface; the piston 8 defines an inner surface; a seal stack 40*a* defines an upper surface; and a seal stack 40*b* defines a lower surface. A lower control line 50*b* is in fluid communication with a lower chamber 55*b* of the ported sleeve 10. The lower chamber 55*b* is defined as follows: the piston housing 3 defines an outer surface; the ported sleeve 10 defines an inner surface; a seal stack 40*d* defines an upper surface; and a seal stack 40*e* defines a lower surface. The control lines 50*a,b* extend from the valve 100 to a source of control fluid at the earth's surface (not shown).

Movement of the piston 8 and the ported sleeve 10 within the valve 100 is controlled by application and removal of pressurized fluid from the upper and lower control lines 50*a,b* to and from the piston 8 and the ported sleeve 10. Specifically, removal of pressurized fluid from the upper chamber 55*a* of the piston 8 by bleeding pressurized fluid from the upper control line 50*a*, and application of pressurized fluid to the lower chamber 55*b* of the ported sleeve 10 by applying pressurized fluid from the lower control line 50*b*, results in upward movement of the piston 8 and the ported sleeve 10. Similarly, removal of pressurized fluid from the lower chamber 55*b* of the ported sleeve 10 by bleeding pressurized fluid from the lower control line 50*b*, and application of pressurized fluid to the upper chamber 55*a* of the piston 8 by applying pressurized fluid from the upper control line 50*a*, results in downward movement of the piston 8 and the ported sleeve 10.

An emergency release block 21 is disposed in the control lines 50*a,b*. The emergency release block 21 has respective fluid channels disposed therethrough, thereby maintaining fluid communication through the control lines 50*a,b*. The fluid channels are connected by a visco-jet disposed in a hole 21*a* which allows fluid communication between the channels. The visco-jet does not affect ordinary actuation of the valve 100, however, in the event that one of the control lines 50*a,b* should become pinched in the wellbore or plugged with debris, the visco-jet allows for manual actuation of the valve 100 by providing relief for the fluid in the pinch or plugged line to the other line.

The upper control line 50*a* connects to the valve 100 at an upper control union 27*a* which is coupled to the piston housing 3 by screws. Coupled to the piston housing 3 at a location proximately below the upper control line union 27*a* is an upper bumper sub 7*a* which is received in a groove in the piston housing 3 and coupled to the piston housing 3 by cap screws. The lower control line 50*b* connects to the valve 100 at a lower control line union 27*b* which is coupled to the piston housing 3 by screws. Coupled to the piston housing 3 at a location proximately below the lower control line union 27*b* is a lower bumper sub 7*b* which is received in a groove in the piston housing 3 and coupled to the piston housing by cap screws. The bumper subs 7*a,b* serve to protect the control lines 50*a,b* from obstructions in the wellbore as the valve 100 is being run-in and as restraints for holding control conduits 800 to the valve 100 (see FIG. 8).

Referring to FIG. 1, the seal stack 40*a* is disposed radially between the piston housing 3 and the piston 8. An upper end of a spacer ring 17*a* is disposed in a recess formed in an inner surface of the bottom tip of the top sub 1. A lower end of the spacer ring 17*a* proximally faces an upper end of the seal stack 40*a*. A snap ring 18*a* is disposed in a groove of the piston housing 3. A spacer ring 38*a* abuts the snap ring 18*a* and also abuts a lower end of the seal stack 40*a*. The seal stack 40*a* is thereby axially coupled to the top sub 1 and the piston housing 3. The seal stack 40*b* is also disposed radially between the piston housing 3 and the piston 8. A retainer ring 41*a* is disposed in a slot formed in the piston 8. Abutting the retainer ring 41*a* is a spacer ring 38*b*. The spacer ring 38*b* proximally faces an upper end of the seal stack 40*b*. A lower end of the seal stack 40*b* abuts a shoulder of the piston 8. The seal stack 40*b* is thereby axially coupled to the piston 8. The seal stacks 40*a,b* isolate the upper chamber 55*a* from the rest of the valve 100.

The seal stack 40*c* is also disposed radially between the piston housing 3 and the piston 8. An upper end of the seal stack 40*c* abuts a shoulder of the piston 8. A retainer ring 41*b* is disposed in a slot formed in the piston 8. Abutting the retainer ring is a spacer ring 38*c*. The spacer ring 38*c* proximally faces a lower end of the seal stack 40*c*. The seal stack 40*c* is thereby axially coupled to the piston 8. The seal stack 40*c* in conjunction with the seal stack 40*b* isolate the interior of the valve 100 from fluid leakage around the J-pins 11 and the J-stop pins 12.

The seal stack 40*d* is disposed radially between the piston housing 3 and the ported sleeve 10. A spacer ring 38*d* abuts a lower end of the piston coupling 9. The spacer ring 38*d* proximally faces an upper end of the seal stack 40*d*. A retainer ring 41*c* is disposed in a slot in the ported sleeve 10. Abutting the retainer ring 41*c* is a spacer ring 38*e*. The spacer ring 38*e* proximally faces a lower end of the seal stack 40*d*. The seal stack 40*d* is thereby axially coupled to the ported sleeve 10. Disposed radially between the piston housing 3 and the ported sleeve 10 is the seal stack 40*e*. A snap ring 18*b* is disposed in a groove of the piston housing 3. A spacer ring 38*f* abuts the snap ring 18*b* and also proximally faces an upper end of the seal stack 40*e*. A spacer ring 38*g* abuts the top tip of the ported housing 4 and also abuts a lower end of the seal stack 40*e*. The seal stack 40*e* is thereby axially coupled to the piston housing 3 and the ported housing 4. The seal stacks 40*d,e* isolate the lower chamber 55*b* from the rest of the valve 100 and the surrounding environment of the valve 100.

The seal stack 39 is disposed radially between the ported housing 4 and the ported sleeve 10. An upper end of the seal stack 39 abuts a shoulder of the ported housing 4. A lower end of a spacer ring 17*b* is disposed in a recess formed in an inner surface of the top tip of the bottom sub 2. An upper end of the spacer ring 17*b* proximally faces an upper end of the seal stack 39. The seal stack 39 is thereby axially coupled to the ported housing 4 and the bottom sub 2. In the event that the radial seals 324 fail, the seal stack 39 will isolate the ported sleeve 10 from the main ports 300 in the ported housing 4 when the valve 100 is in the fully closed position.

An O-ring 37*a* is disposed in a groove, formed in the piston 8, proximate to the retainer ring 41*a*. An O-ring 37*b* is disposed in a groove, formed in the piston 8, proximate to the retainer ring 41*c*. The O-rings 37*a,b* do not provide any sealing function. Their purpose is to shoulder against the spacer rings 38*a,f*, respectively, so that the spacer rings 38*a,f* may be removed during disassembly of the valve 100. Removal of the spacer rings 38*a,f* allows for the retainer rings 18*a,b*, respectively, to be compressed against tapered walls of the piston housing 3. The reason that there are two O-rings 37*a,b* is because the piston 8/ported sleeve 10 sub-assembly may be removed out of either an upper end or a lower end of the piston housing 3.

In the event of failure of any of the seal stacks 40*a,b,d,e* in the valve 100 or pinching or plugging of the control lines 50*a,b*, a lower end of the ported sleeve 10 is configured to form a locating profile 60*a* for locating a hydraulically actuated shifting tool (not shown). The shifting tool may be run in on coiled tubing or other suitable device. The shifting tool includes a spring-loaded axial drag block for engaging the locator profile 60*a*. The shifting tool is configured so that once the spring-loaded axial drag block engages with the locator profile 60*a*, a fluid-actuated axial drag block will be aligned with a shifting profile 60*b*. The hydraulically-actuated axial drag block may then be extended to engage the shifting profile 60*b*, thereby allowing an actuation force to be exerted on the ported sleeve 10.

FIG. 2 is a side view of the piston housing 3 of the valve 100 of FIG. 1 with hidden lines showing sectional features. FIGS. 2A, 2B, 2C, and 2D are sectional views taken along the lines 2A-2A, 2B-2B, 2C-2C, and 2D-2D of FIG. 2, respectively. Referring also to FIG. 1, disposed in respective radial holes 200 through the piston housing 3 are at least one J-stop pin 12 (preferably two) and at least one breather pin 13 (preferably two). Each wall of each hole 200 has a groove for receiving a retainer ring 31 which, along with a shoulder in each wall, radially couple each J-stop pin 12 or breather pin 13 to the piston housing 3. A filter disc 14 is also disposed in each hole 200 having a breather pin 13. Also disposed in at least one radial hole 205 (eight as shown) through the piston housing 3 is at least one J-pin 11 (preferably eight). Each wall of each hole 205 also has a groove for receiving a retainer ring 30 which, along with a shoulder in each wall, radially couple each J-pin 11 to the piston housing 3. The breather pins 13 and filter discs 14 are optional.

Formed in an outer surface of the piston housing 3 are upper 220*a* and lower 220*b* landing recesses for receiving upper 27*a* and lower 27*b* control line unions, respectively. Radially disposed through the piston housing 3 are upper 215*a* and lower 215*b* control line ports which provide fluid communication paths between the upper 27*a* and lower 27*b* control line unions and the upper piston 55*a* and lower ported sleeve chambers 55*b*, respectively. Disposed in an outer surface of the piston housing 3 are upper 225*a* and lower 225*b* tapered regions for receiving the upper 7*a* and lower 7*b* bumper subs, respectively. Respectively disposed in the upper and lower tapered regions 225*a,b* are upper and lower locator recesses 230*a,b* for properly aligning the upper and lower bumper subs 7*a,b*, respectively. Disposed in an inner surface of a bottom tip of the piston housing 3 are a plurality of dowel slots 210. The dowel slots 210 receive an upper end of the dowel pins 29 for rotationally coupling the piston housing 3 to the ported housing 4.

Figure 3:
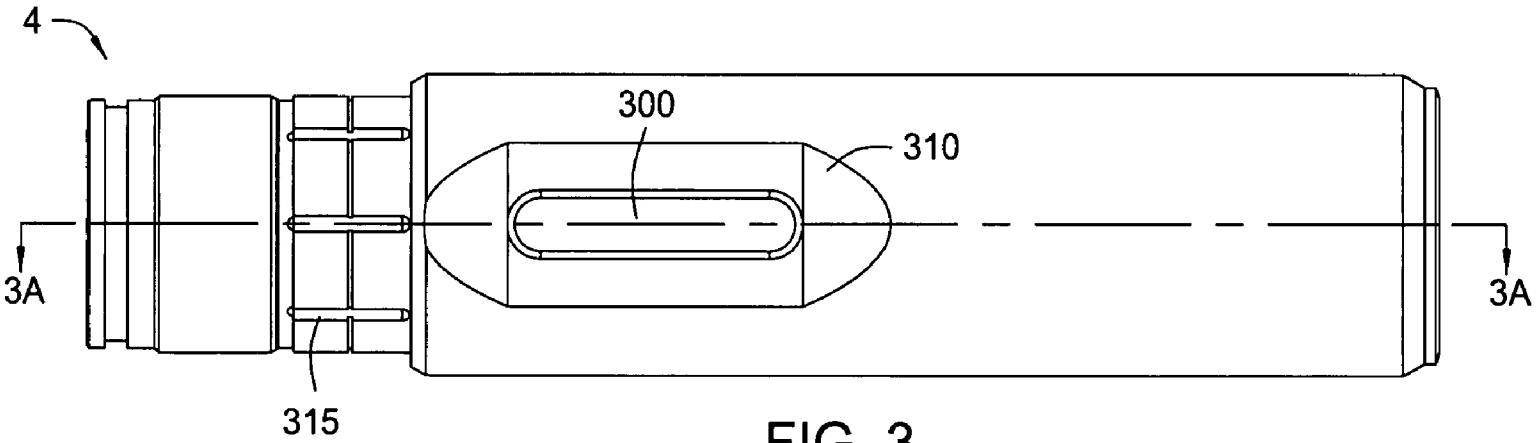
FIG. 3 is a side view of the ported housing 4 of the valve of FIG. 1.
Figure 3A:
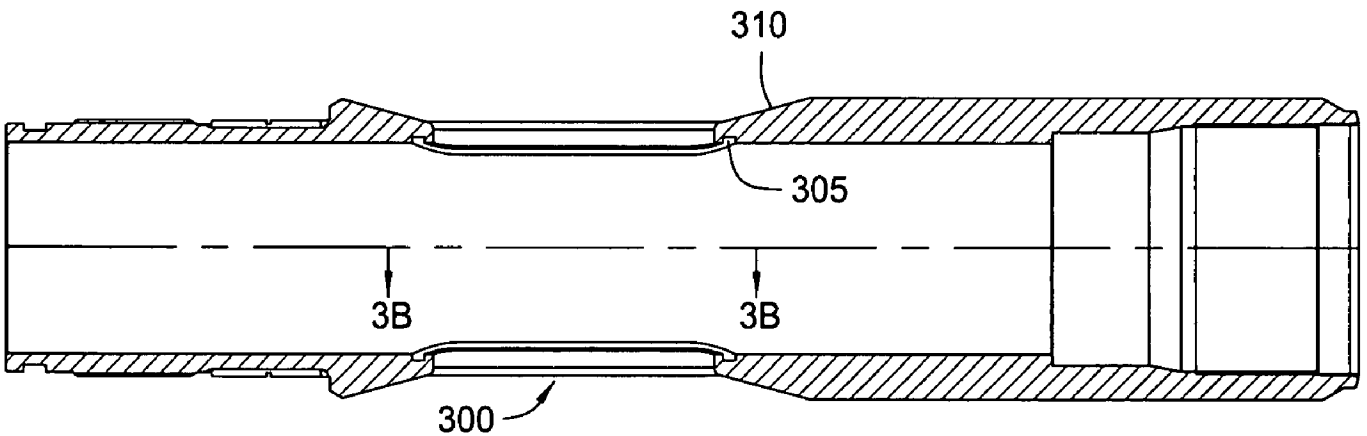
FIG. 3A is a sectional view taken along lines 3A-3A of FIG. 3.
Figure 3C:
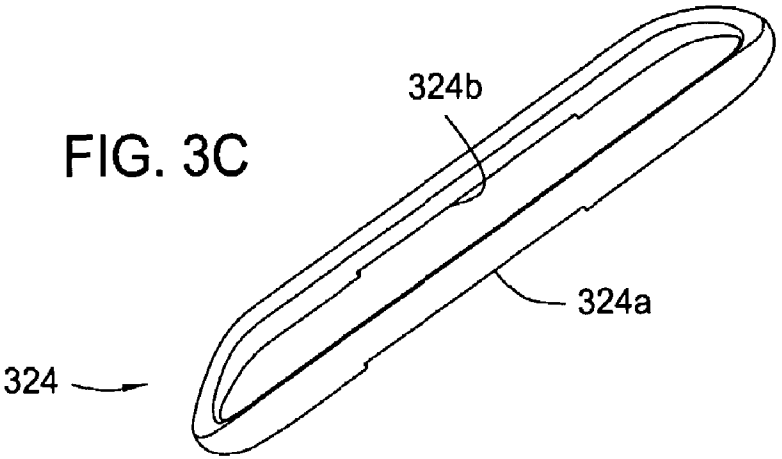
FIG. 3C is an isometric view of a radial seal.
Figure 3D:
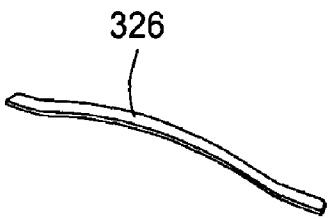
FIG. 3D is an isometric view of a beam spring.
Figure 3B:
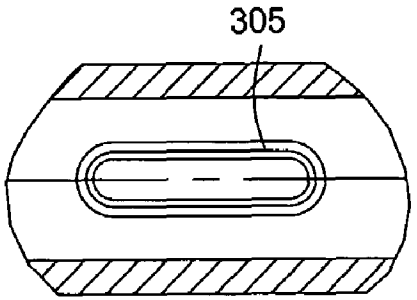
FIG. 3B is a sectional view taken along lines 3B-3B of FIG. 3A.

FIG. 3 is a side view of the ported housing 4 of the valve 100 of FIG. 1. FIG. 3A is a sectional view taken along lines 3A-3A of FIG. 3. FIG. 3B is a sectional view taken along lines 3B-3B of FIG. 3A. FIG. 3C is an isometric view of a radial seal 324. FIG. 3D is an isometric view of a beam spring 326. Disposed in an outer surface of an upper end of the ported housing 4 are a plurality of dowel slots 315. The dowel slots 315 receive a lower end of the dowel pins 29 for rotationally coupling the piston housing 3 to the ported housing 4. Disposed radially through the ported housing are two main ports 300. The main ports 300 align with slots 605, 610 (see FIG. 6) to provide fluid communication between the interior of the valve 100 and the surrounding environment of the valve when the valve is in the fully open and various choke positions, respectively. Alternatively, the valve 100 may have one main port or more than two main ports.

Tapered regions 310 are formed in an outer surface of the ported housing 4, proximate the main ports 300, respectively, to transition the flow of fluid in or out of the main ports 300. A groove 305 is disposed in an inner surface of a wall of each of the ports 300 and receives two beam springs 326 (only one shown) and the radial seal 324. Two recesses 324*a* and 324*b* are formed in an inner surface of each of the radial seals 324 for receiving the beam springs 326. The beam springs 326 bias the radial seals 324 inward into sealing engagement with an outer surface of the ported sleeve 10. Each of the radial seals 324 isolates the flow paths between the main ports 300 and the slots 605,610 from an annular space between the ported housing 4 and the ported sleeve 10. The radial seals 324 are made from a thermoplastic or elastomeric polymer.

To assemble the radial seals 324 and the beam springs 326 into the grooves 305, a film of grease (not shown) is first deposited in each of the grooves 305 and on inner surfaces of the beam springs 326. The beam springs 326 are then placed into the grooves 305 and then the radial seals 324 are placed into the grooves over the beam springs. The grease serves to retain the beam springs 326 and radial seals 324 in the grooves 305. A tapered mandrel (not shown) is then inserted into the ported housing 4 which slightly compresses the radial seals 324 and the beam springs 326. A second mandrel (not shown) having an outside diameter larger than the tapered section of the tapered mandrel and less than the ported sleeve 10 is then inserted into the ported housing 4 which further compresses the radial seals 324 and the beam springs 326. The tapered mandrel is then removed. The ported sleeve 10 is inserted into the ported housing 4 which further compresses the radial seals 324 and the beam springs 326. The second mandrel may then be removed.

Figure 6:
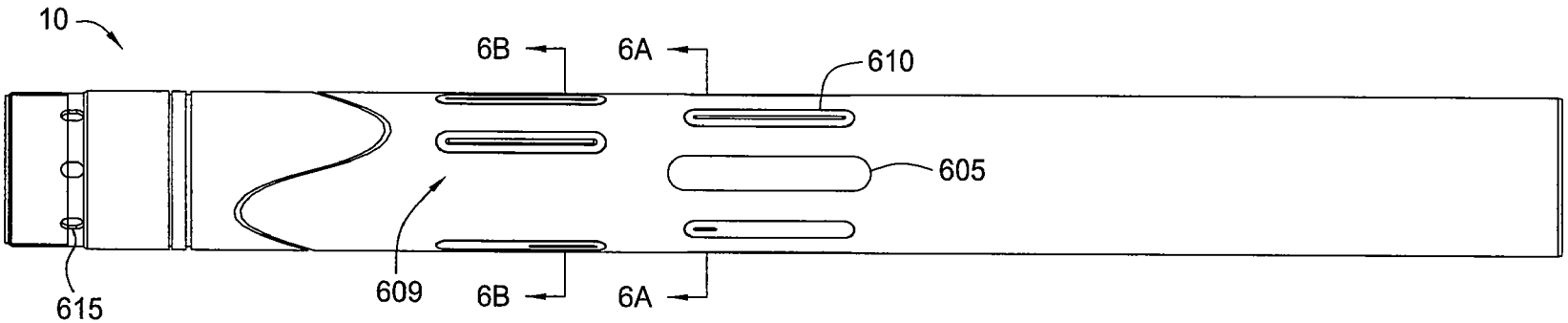
FIG. 6 is a side view of the ported sleeve of the valve of FIG. 1.
Figure 6B:
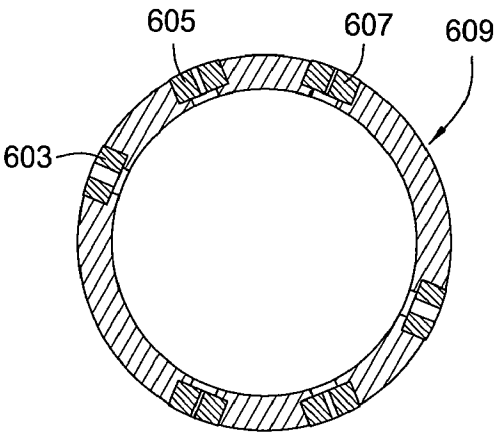
FIGS. 6A and 6B are sectional views of the ported sleeve taken along the lines 6A-6A and 6B-6B of FIG. 6, respectively.
Figure 6A:
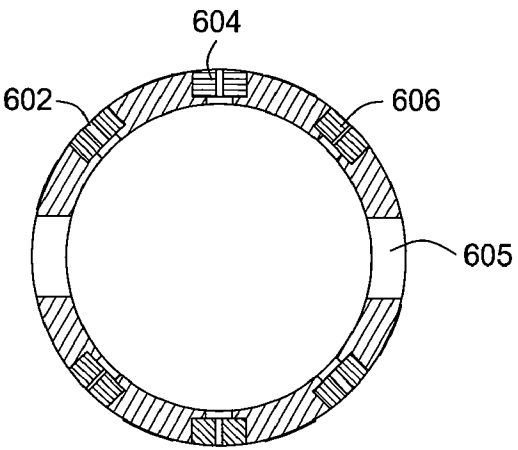

FIG. 6 is a side view of the ported sleeve 10 of the valve 100 of FIG. 1. FIGS. 6A and 6B are sectional views of the ported sleeve taken along the lines 6A-6A and 6B-6B of FIG. 6, respectively. Disposed through the ported sleeve 10 are two rows of circumferentially spaced slots. A lower row of the two rows includes two slots 605. When the slots 605 are aligned with the main ports 300, the valve 100 is in the fully open position. Both rows include a plurality of smaller slots 610. Disposed in the smaller slots 610 are a plurality of hardened (preferably, tungsten carbide) inserts 602-607. Each of the inserts 602-607 has a flow slot therethrough. The insert flow slots are variously sized according to the desired flow characteristics of the various choke positions of the valve 100. When the various insert flow sots are aligned with the main ports 300, the valve is in respective choked positions. Preferably, and as illustrated, the valve 100 has six choke positions, however, the valve may have any number of choke positions. Note that the upper row of slots appears to be missing two slots at locations 609. The locations 609 that would otherwise be slotted correspond to the fully closed position of the valve 100.

Figure 4A:
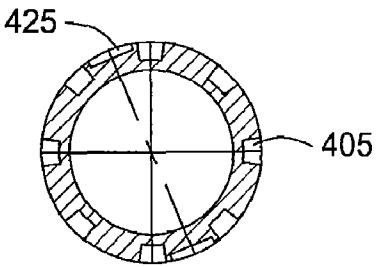
FIG. 4A is a sectional view taken along the line 4A-4A of FIG. 4.

FIG. 4 is a side view of the piston 8 of the valve 100 of FIG. 1. FIG. 4A is a sectional view taken along the line 4A-4A of FIG. 4. The J-pins 11 and J-stop pins 12 extend radially into a recessed profile 400 of the piston 8 which extends circumferentially around the piston and axially along a substantial length thereof. Interaction of the J-pins 11 and J-stop pins 12 with the recessed profile 400 causes the piston 8 and ported sleeve 10 to rotate relative to the housings 3,4 (and other stationary parts) when the piston and ported sleeve are axially actuated by the control lines 50*a*,*b*. This motion is analogous to that of a simple top-click ball point pen.

The recessed profile 400 includes at least one upper J-slot 405 (preferably eight), at least one upper J-slot shoulder 410 (preferably two), at least one lower J-slot 415 (preferably eight), and at least one lower J-slot shoulder 420 (preferably two),. The recessed profile 400 further includes at least one upper J-stop slot 425 (preferably two), at least one upper J-stop guide 430 (preferably eight), at least one J-stop shoulder 435 (preferably six), and at least one lower J-stop guide 440 (preferably eight). Each of the guides 430,440 includes an inclined face 430*a*,440*a* and a straight face 430*b*,440*b*. The J-stop pins 12 extend radially inward past a full outside diameter of the piston 8 at a first radial length corresponding to a first radial depth of the J-stop slots 425, shoulders 435 and guides 430,440. The J-pins 11 extend radially inward past a full outside diameter of the piston 8 at a second radial length corresponding to a second radial depth of the J-slots 405,415 and J-slot shoulders 410,420. The second radial depth is deeper than the first radial depth.

Figure 9A:
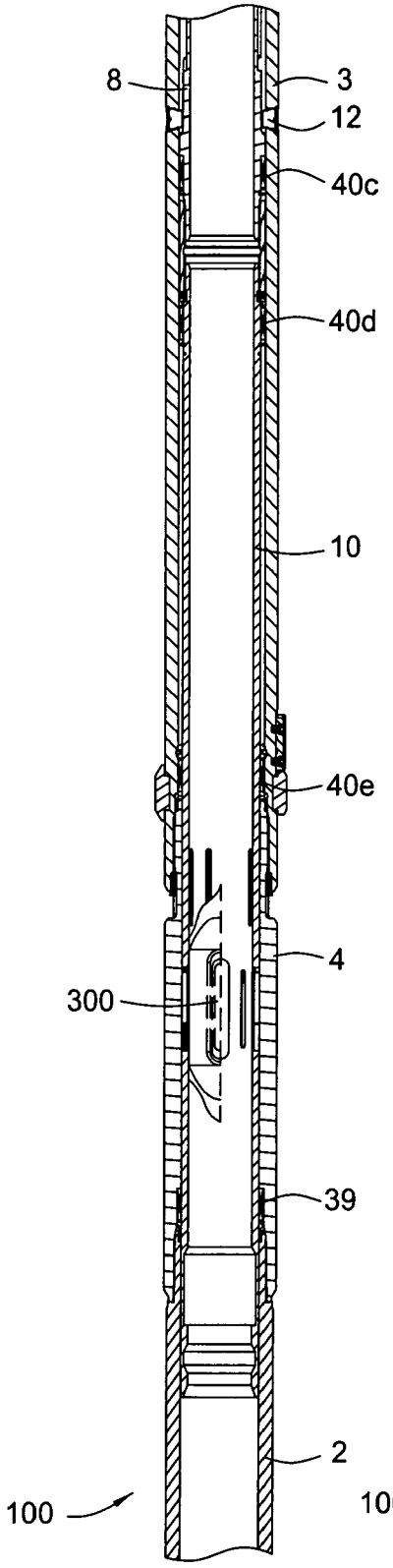
FIGS. 9A-F are section views of a portion of the valve of FIG. 1 in various operational positions of the valve
Figure 9C:
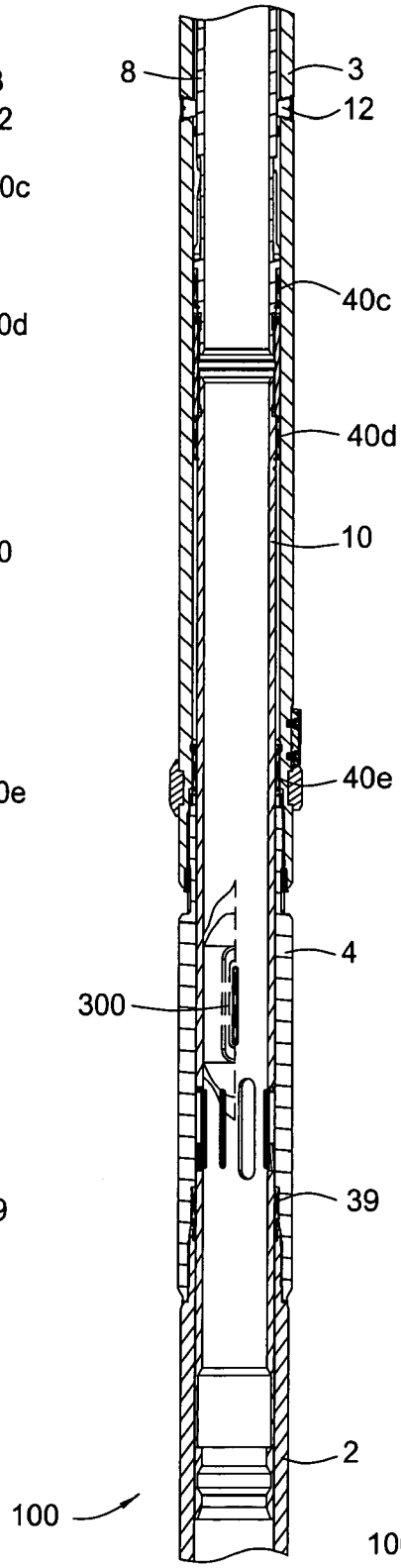
Figure 9E:
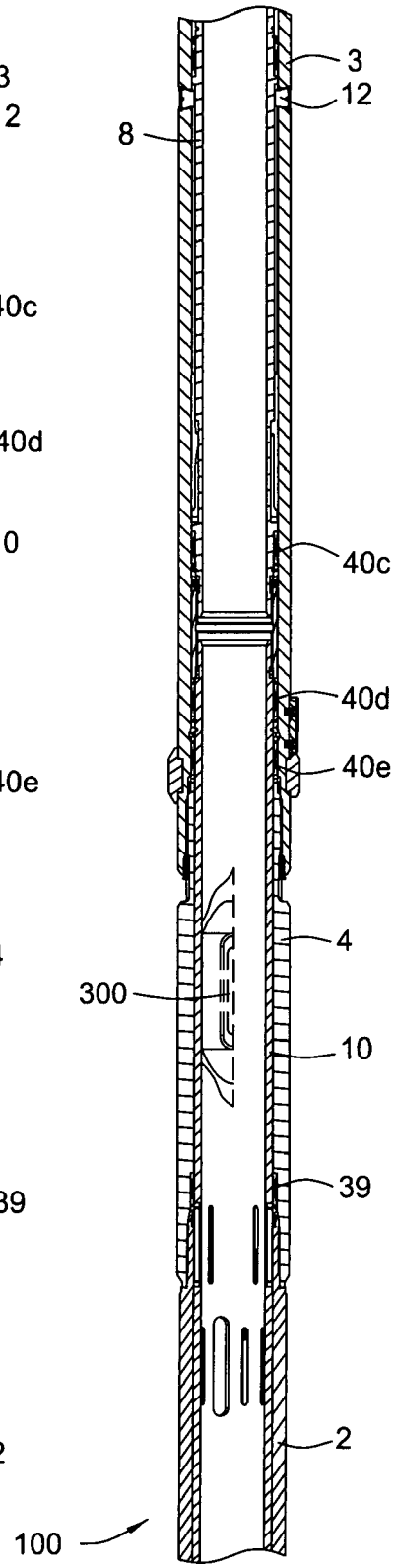
Figure 9B:
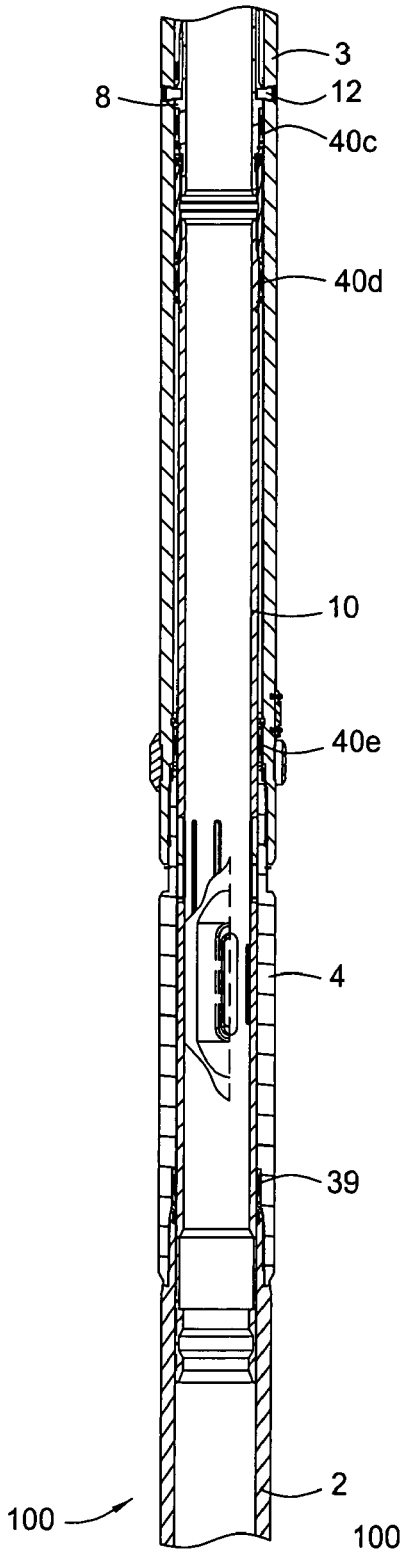
Figure 9D:
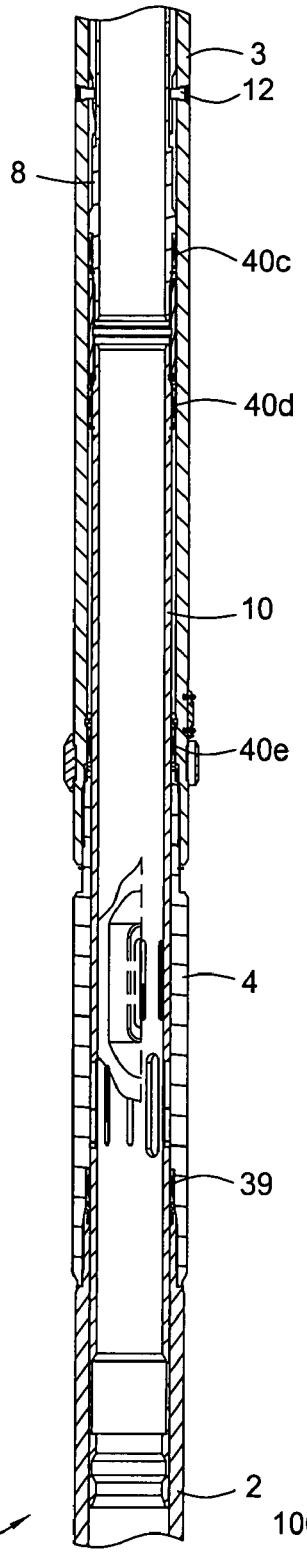
Figure 9F:
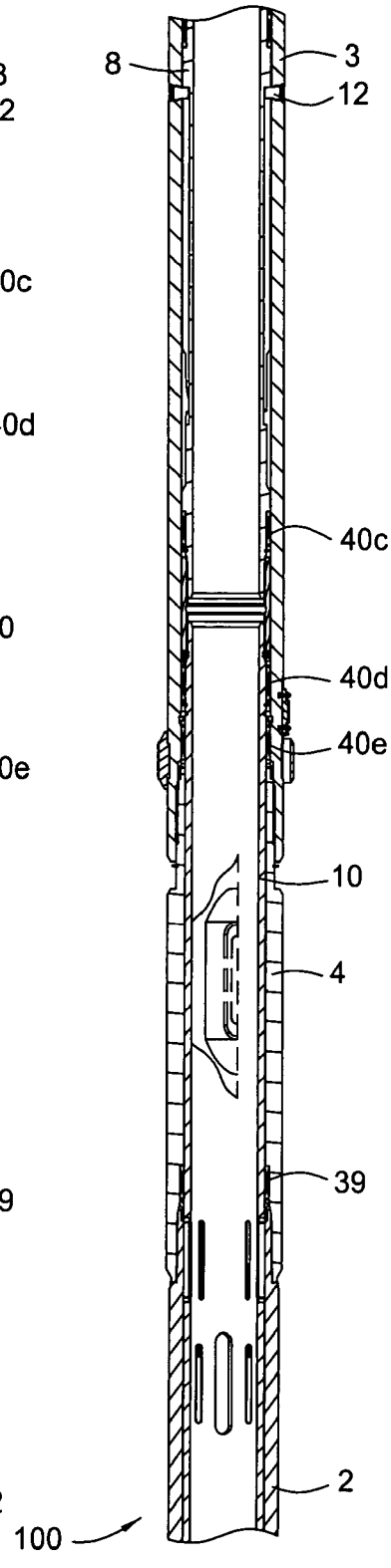

FIGS. 9A-F are section views of a portion of the valve 100 in various operational positions of the valve. FIGS. 9A and 9B are views of the valve in the fully open position. FIGS. 9C and 9D are views of the valve 100 in one of the choked positions. FIGS. 9E and 9F are views of the valve 100 in the fully closed position. FIGS. 9A, 9C, and 9E are section views cut through two of the J-stop pins 12, similar to the half-section of FIG. 1. FIGS. 9B, 9D, and 9F are section views cut through two of the J-pins 11.

Referring to FIGS. 4, 9A, and 9B, starting with the valve 100 at a fully open position, the J-pins 11 abut the lower J-slot shoulders 420. At this point, the main ports 300 of the ported housing 4 are aligned with the slots 605. The piston 8 is then actuated downward and travels axially until the J-pins 11 contact the inclined faces 430*a* of the upper J-stop guides 430. Contact of the J-pins 11 with the inclined faces 430*a* cause the piston 8 to rotate until the J-pins 11 engage the straight face 430*b* of the upper J-stop guides 430. The J-stop pins 12 then abut with the J-stop shoulders 435. At this point, the inserts 607 are aligned with the main ports 300 and the valve 100 is in a first choked position as illustrated in FIGS. 9C and 9D.

To actuate the valve to the next choked position, the piston 8 is actuated axially upward. The piston 8 travels axially until the J-pins 11 contact the inclined faces 440*a* of the lower J-stop guides 440. Contact of the J-pins 11 with the inclined faces 440*a* causes the piston 8 to rotate until the J-pins 11 engage the straight face 440*b* of the lower J-stop guides 440. The piston 8 then travels axially as the J-pins 11 are traveling in the lower J-slots 415 until the J-pins 11 abut the lower J-slot shoulders 420. At this point, the inserts 607 are aligned with the main ports 300 and the valve 100 is in a second choked position.

This process is repeated through all of the choked positions until the last choked position, where the inserts 602 are aligned with the main ports 300. Upon actuation from the last choked position, the J-stop pins 12 align with the J-stop slots 425. At this point, the locations 609 are circumferentially aligned with the main ports 300, however, instead of the piston 8 stopping when the J-stop pins 12 abut with the J-stop shoulders 435, the piston will continue to travel axially downward since the J-stop pins are aligned with the J-stop slots 425. The piston 8 will continue its axial motion until the J-pins 11 abut the upper J-slot shoulders 410. At this point, the valve will be in a fully closed position, as shown in FIGS. 9E and 9F, since both rows of the slots in the ported sleeve 10 will have moved axially past the seal stack 39 which isolates them from the main ports 300. The next position of the valve 100 will then be the fully opened position.

Figure 8:
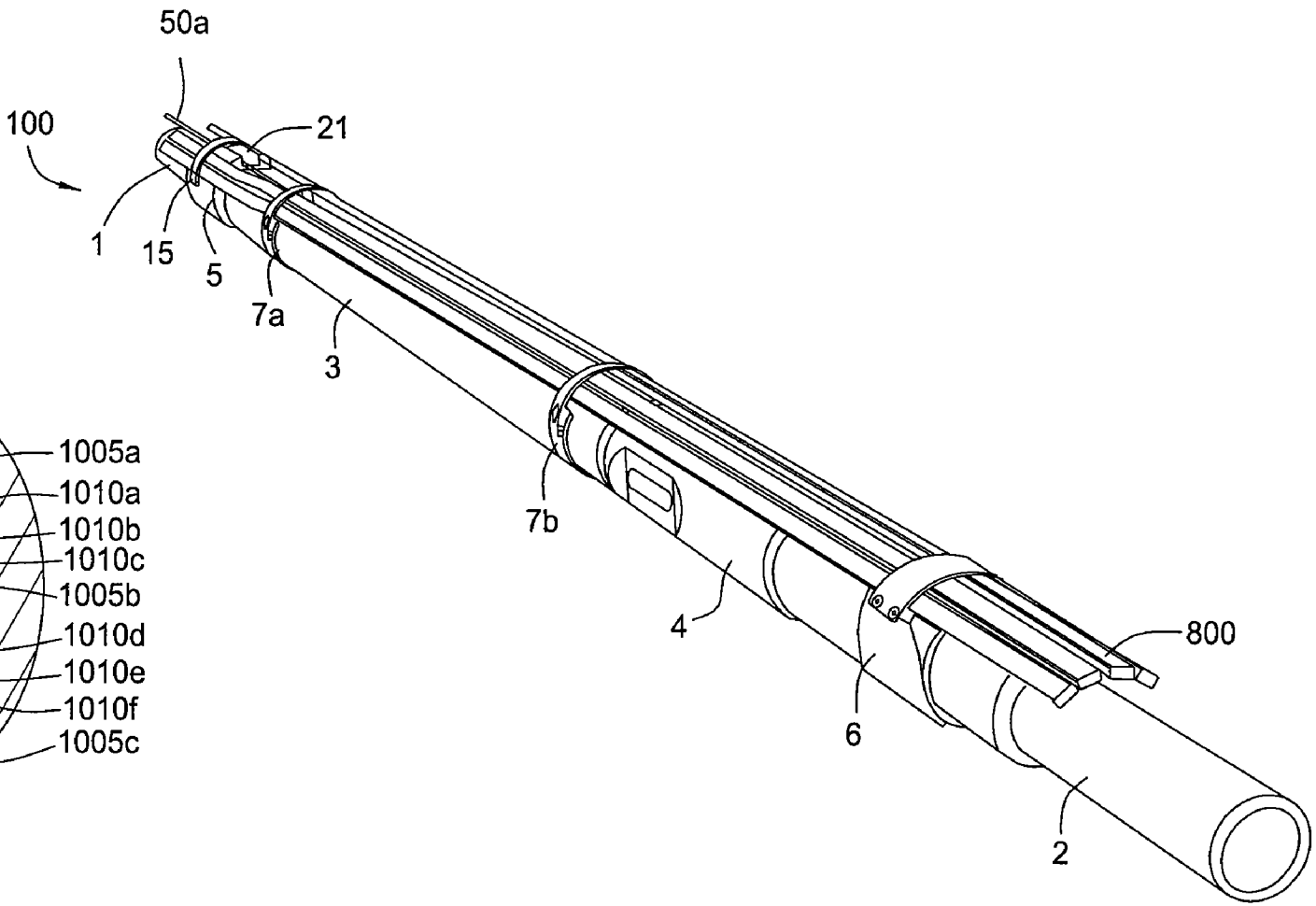
FIG. 8 is an isometric view of the of valve of FIG. 1.

FIG. 8 is an isometric view of the valve 100. Control line conduits 800 run through the upper 15 and lower 16 control line clamps and also the upper 7*a* and lower 7*b* bumper subs. The control line conduits 800 house control cables (not shown) that run to various other tools (not shown) which may be run into the wellbore with the valve 100.

Figure 10:
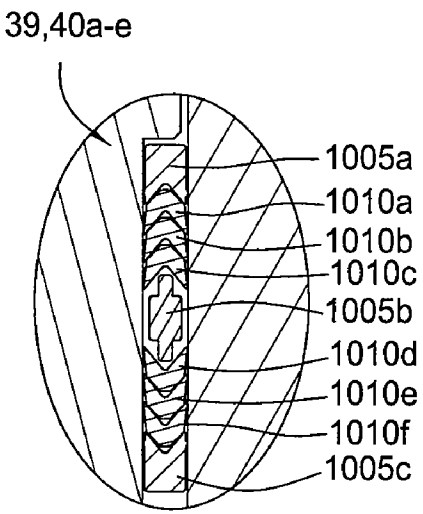
FIG. 10 is a detailed sectional view of seal stacks of the valve of FIG. 1.

FIG. 10 is a detailed sectional view of seal stacks 39 and 40*a*-*e*. Seal stacks 39 and 40*a*-*d* include a number of components which cooperate together to form a fluid-tight seal. As shown, seal stacks 39 and 40*a*-*e* are each equipped with a center adapter 1005*b*, and upper 1005*a* and lower 1005*c* end adapters. The adapters 1005*a*-*c* essentially serve as spacers and to prevent the flow of sealing elements 1010*a*-*f*.

Three upper sealing elements 1010*a*-*c* are disposed between center adapter 1005*b* and upper end adapter 1005*a*. Likewise, three lower sealing elements 1010*d*-*f* are disposed between center adapter 1005*b* and lower end adapter 1005*b*. The sealing elements 1010*a*-*f* are subjected to axial compressive force which flares the sealing elements radially outward slightly to engage, on one side, an outer member (i.e., piston housing 3) and to engage, on the other side, an inner member (i.e. piston 8). Engagement of the sealing elements 1010*a-f* and the inner and outer members can withstand significant pressure differentials, and maintain a tight seal. Each of the sealing elements 1010*a-f* is equipped with one male end and one female end. Each female end is equipped with a central cavity which receives the male end of either another sealing element or the center adapter 1005*b*.

The adapters 1005*a-c* may be made of any substantially hard nonelastomeric material, such as a thermoplastic polymer, or they may be made of metal. Examples of a suitable thermoplastic polymer are Polyetheretherkeytone (PEEK), PEK, PEKK, or any combination of PEEK, PEK, and PEKK. Preferably, the adapters 1005*a-c* are constructed from a relatively hard material as compared to a preferable soft material of the sealing elements 1010*a-f*. Examples of the relatively soft material are TEFLON (Du-Pont Trademark), rubber, and any elastomeric polymer.

While the foregoing is directed to embodiments of the present invention, other and further embodiments of the invention may be devised without departing from the basic scope thereof, and the scope thereof is determined by the claims that follow.

The invention claimed is:

1. A variable choke valve for use in a wellbore, comprising:

a tubular housing having an axial bore therethrough and a port through a wall thereof;

a tubular sleeve having an axial bore therethrough and first and second holes through a wall thereof and disposed within the housing; and a port seal disposed between the housing and the sleeve and extending along a periphery of the port, wherein:

the first hole is larger than the second hole, the sleeve is actuatable among at least three positions:

a first position where the first hole is at least partially aligned with the port, a second position where the second hole is at least partially aligned with the port, and a third position where the sleeve wall obstructs the port.

2. The variable choke valve of claim 1, further comprising a sealing member disposed between the housing and the sleeve and distally from the port, wherein the holes move past the sealing member when the sleeve is actuated to the third position, thereby isolating the holes from the port.

3. The variable choke valve of claim 2, wherein the sealing member is a seal stack.

4. The variable choke valve of claim 1, further comprising an annular sealing member disposed around the housing and distally from the port so that the sealing member isolates the holes from the port when the sleeve is in the third position.

5. The variable choke valve of claim 4, wherein the sealing member is a seal stack.

6. The variable choke valve of claim 1, further comprising a spring disposed between the sealing member and the housing, the spring biasing the port seal into engagement with the sleeve.

7. The variable choke valve of claim 1, wherein:

the second hole is axially and circumferentially spaced from the first hole, the sleeve is axially actuatable, and the sleeve and housing are coupled so that the sleeve will rotate as the sleeve is being axially actuated.

8. The variable choke valve of claim 7, wherein one of the sleeve and the housing has a first pin disposed thereon and the other one of the sleeve and the housing has a profiled surface configured to guide the first pin so that the sleeve will rotate as the sleeve is being axially actuated.

9. The variable choke valve of claim 8, wherein the one of the sleeve and the housing that has the first pin disposed thereon further has a second pin disposed thereon and the profiled surface is further configured to guide the second pin so that actuation of the sleeve will cease when the sleeve has reached any of the three positions.

10. The variable choke valve of claim 7, wherein:

the sleeve has a third hole disposed through the wall thereof which is smaller than the first and second holes and axially aligned with the first hole, and the sleeve is actuatable among at least four positions, the third hole being at least partially aligned with the port when the sleeve is in the fourth position.

11. The variable choke valve of claim 10, wherein the valve is configured so that the sleeve is axially actuated from the first position to the second position in a first axial direction and the sleeve is axially actuated from the second position to the fourth position in a second axial direction, which is opposite to the first axial direction.

12. The variable choke valve of claim 1, wherein the sleeve is axially actuatable by a pressurized fluid, the sleeve actuatable in two axial directions by two fluid lines connectable to the valve and the valve further comprises a bleed which provides limited fluid communication between the two fluid lines.

13. A method of using the variable choke valve of claim 1, comprising:

assembling the variable choke valve with a tubing string; and running the tubing string into a wellbore so that the valve is proximate to an oil or gas formation.

14. A variable choke valve for use in a wellbore, comprising:

a tubular housing having a longitudinal bore therethrough and a port through a wall thereof;

a tubular sleeve having a longitudinal bore therethrough and first and second holes through a wall thereof and disposed within the housing; and a port seal disposed between the housing and the sleeve and extending along a periphery of the port, wherein:

the first hole is substantially larger than the second hole, and the sleeve is moveable among at least three positions:

an open position where the first hole is at least substantially aligned with the port, a first choked position where the second hole is at least substantially aligned with the port, and a closed position where the sleeve wall covers the port.

15. The variable choke valve of claim 14, further comprising an annular seal assembly disposed between the housing and the sleeve, wherein the annular seal assembly isolates the holes from the port when the sleeve is in the closed position.

16. The variable choke valve of claim 15, wherein the annular seal assembly comprises:

a first substantially chevron shaped seal in a first longitudinal orientation; and a second substantially chevron shaped seal in a second longitudinal orientation, wherein the second orientation is opposite the first orientation.

17. The variable choke valve of claim 16, wherein the port seal and the annular seal assembly are made from a polymer.

18. The variable choke valve of claim 14, further comprising a spring disposed between the port seal and the housing, the spring biasing the seal into engagement with the sleeve.

19. The variable choke valve of claim 18, wherein the spring is a beam spring.

20. The variable choke valve of claim 14, wherein:

the second hole is longitudinally and circumferentially spaced from the first hole, the sleeve is longitudinally moveable relative to the housing, and the sleeve and housing are coupled together with a pin and J-slot coupling.

21. The variable choke valve of claim 20, wherein:

the sleeve has a third hole disposed through the wall thereof which is substantially smaller than the first and second holes and longitudinally aligned with the first hole, and the sleeve is moveable among at least four positions, the third hole being at least substantially aligned with the port when the sleeve is in a second choked position.

22. The variable choke valve of claim 14, wherein the second hole is lined with a carbide insert.

23. The variable choke valve of claim 14, wherein an outer surface of the housing proximate to the port is tapered.

24. The variable choke valve of claim 14, further comprising first and second piston seal assemblies disposed between the housing and the sleeve and isolating a hydraulic chamber for moving the sleeve.

25. The variable choke valve of claim 14, wherein the first hole is substantially the same size and shape as the port.

26. The variable choke valve of claim 25, wherein the first hole is essentially the same size and shape as the port.

27. The variable choke valve of claim 14, wherein the port is an oval slot and the port seal is oval shaped.

28. A method of using the variable choke valve of claim 14, comprising:

assembling the variable choke valve with a tubing string; and running the tubing string into a wellbore so that the valve is proximate to an oil or gas formation.

29. The method of claim 28, further comprising:

producing formation fluid to a surface of the wellbore through the valve and the tubing string.

30. The method of claim 28, further comprising:

treating the formation by injecting fluid from a surface of the wellbore to the formation through the tubing string and the valve.

* * * * *